US008886537B2

(12) United States Patent
Goldberg et al.

(10) Patent No.: US 8,886,537 B2
(45) Date of Patent: Nov. 11, 2014

(54) METHOD AND SYSTEM FOR TEXT-TO-SPEECH SYNTHESIS WITH PERSONALIZED VOICE

(75) Inventors: Itzhack Goldberg, Hadera (IL); Ron Hoory, Haifa (IL); Boaz Mizrachi, Haifa (IL); Zvi Kons, Yokneam Ilit (IL)

(73) Assignee: Nuance Communications, Inc., Burlington, MA (US)

( * ) Notice: Subject to any disclaimer, the term of this patent is extended or adjusted under 35 U.S.C. 154(b) by 1782 days.

(21) Appl. No.: 11/688,264

(22) Filed: Mar. 20, 2007

(65) Prior Publication Data

US 2008/0235024 A1 Sep. 25, 2008

(51) Int. Cl.
*G10L 13/00* (2006.01)
*G10L 13/033* (2013.01)
*G10L 13/04* (2013.01)

(52) U.S. Cl.
CPC ..... *G10L 13/033* (2013.01); *G10L 13/04* (2013.01)
USPC ..... 704/258

(58) Field of Classification Search
CPC ..... G10L 13/08; G10L 13/10
USPC ..... 704/258–269
See application file for complete search history.

(56) References Cited

U.S. PATENT DOCUMENTS 5,634,084 A * 5/1997 Malsheen et al. ..... 704/260
5,640,590 A 6/1997 Luther
5,913,193 A 6/1999 Huang et al.
6,081,780 A * 6/2000 Lumelsky ..... 704/260
6,662,161 B1 * 12/2003 Cosatto et al. ..... 704/260
6,766,295 B1 * 7/2004 Murveit et al. ..... 704/243
6,792,407 B2 * 9/2004 Kibre et al. ..... 704/260
6,963,889 B1 11/2005 Yellin
6,970,820 B2 * 11/2005 Junqua et al. ..... 704/258
7,277,855 B1 * 10/2007 Acker et al. ..... 704/260
7,664,645 B2 * 2/2010 Hain et al. ..... 704/269

(Continued)

FOREIGN PATENT DOCUMENTS

WO WO2005013596 A1 2/2005

OTHER PUBLICATIONS

Chunling Ma et al. "A chat system based on Emotion Estimation from text and embodied Conversational Messengers", Publisher: Springer-Verlag, Berlin, Germany, Proceeding of ICEC, Sep. 2005.

*Primary Examiner* — Jialong He
(74) *Attorney, Agent, or Firm* — Wolf, Greenfield & Sacks, P.C.

(57) ABSTRACT

A method and system are provided for text-to-speech synthesis with personalized voice. The method includes receiving an incidental audio input (403) of speech in the form of an audio communication from an input speaker (401) and generating a voice dataset (404) for the input speaker (401). The method includes receiving a text input (411) at the same device as the audio input (403) and synthesizing (312) the text from the text input (411) to synthesized speech including using the voice dataset (404) to personalize the synthesized speech to sound like the input speaker (401). In addition, the method includes analyzing (316) the text for expression and adding the expression (315) to the synthesized speech. The audio communication may be part of a video communication (453) and the audio input (403) may have an associated visual input (455) of an image of the input speaker. The synthesis from text may include providing a synthesized image personalized to look like the image of the input speaker with expressions added from the visual input (455).

20 Claims, 7 Drawing Sheets

(56) References Cited

U.S. PATENT DOCUMENTS

| | | | | |
|---|---|---|---|---|
| 7,693,719 | B2 * | 4/2010 | Chu et al. | 704/270.1 |
| 7,706,510 | B2 * | 4/2010 | Ng | 704/260 |
| 2002/0173962 | A1 * | 11/2002 | Tang et al. | 704/260 |
| 2004/0176957 | A1 | 9/2004 | Reich | |
| 2004/0267531 | A1 | 12/2004 | Whynot et al. | |
| 2005/0071163 | A1 * | 3/2005 | Aaron et al. | 704/260 |
| 2005/0137862 | A1 * | 6/2005 | Monkowski | 704/222 |
| 2005/0223078 | A1 | 10/2005 | Sato et al. | |
| 2005/0256716 | A1 * | 11/2005 | Bangalore et al. | 704/260 |
| 2005/0273338 | A1 * | 12/2005 | Aaron et al. | 704/267 |
| 2006/0074672 | A1 * | 4/2006 | Allefs | 704/258 |
| 2006/0095265 | A1 * | 5/2006 | Chu et al. | 704/268 |
| 2006/0149558 | A1 * | 7/2006 | Kahn et al. | 704/278 |
| 2006/0229876 | A1 * | 10/2006 | Aaron et al. | 704/263 |

* cited by examiner

METHOD AND SYSTEM FOR TEXT-TO-SPEECH SYNTHESIS WITH PERSONALIZED VOICE

FIELD OF THE INVENTION

This invention relates to the field of text-to-speech synthesis. In particular, the invention relates to providing personalization to the synthesised voice in a system including both audio and text capabilities.

BACKGROUND OF THE INVENTION

Text-to-speech (TTS) synthesis is used in various different environments in which text is input or received at a device and audio speech output of the content of the text is output. For example, some instant messaging (IM) systems use TTS synthesis to convert text chat to speech. This is very useful for blind people, people or young children who have difficulties reading, or for anyone who does not want to change his focus to the IM window while doing another task.

In another example, some mobile telephone or other handheld devices have TTS synthesis capabilities for converting text received in short message service (SMS) messages into speech. This can be delivered as a voice message left on the device, or can be played straightaway, for example, if an SMS message is received while the recipient is driving. In a further example, TTS synthesis is used to convert received email messages to speech.

A problem with TTS synthesis is that the synthesized speech loses a person's identity. In the IM application where multiple users may be contributing during a session, all IM participants whose text is converted using TTS may sound the same. In addition, the emotions and vocal expressiveness that can be conveyed using emotion icons and other text based hints are lost.

US 2006/0074672 discloses an apparatus for synthesis of speech using personalized speech segments. Means are provided for processing natural speech to provide personalized speech segments and means are provided for synthesizing speech based on the personalized speech segments. A voice recording module is provided and speech input is made by repeating words displayed on a user interface. This has the drawback that speech can only be synthesized to personalized speech that has been input into the device by a user repeating the words. Therefore, the speech cannot be synthesized to sound like a person who has not purposefully input their voice into the device.

In relation to the expression of synthesized voice, it is known to put specific commands inside a multimedia message or in a script in order to force different emotion of the output speech in TTS synthesis. In addition, IM systems with expressive animations are known from "A chat system based on Emotion Estimation from text and Embodied Conversational Messengers", Chunling Ma, et al (ISBN: 3 540 29034 6) in which an avatar associated with a chat partner acts out assessed emotions of messages in association with synthesized speech.

SUMMARY OF THE INVENTION

An aim of the invention is to provide TTS synthesis personalized to the voice of the sender of the text input. In addition, expressiveness may also be provided in the personalized synthesized voice.

A further aim of the invention is to personalize a voice from a recording of a sender during a normal audio communication. A sender may not be aware that the receiver would like to listen to his text with TTS or that his voice has been synthesized from any voice input received at a receiver's device.

According to a first aspect of the present invention there is provided a method for text-to-speech synthesis with personalized voice, comprising: receiving an incidental audio input of speech in the form of an audio communication from an input speaker and generating a voice dataset for the input speaker; receiving a text input at a same device as the audio input; synthesizing the text from the text input to synthesized speech including using the voice dataset to personalize the synthesized speech to sound like the input speaker.

Preferably, the method includes training a concatenative synthetic voice to sound like the input speaker. Personalising the synthesized speech may include a voice morphing transformation.

The audio input at a device is incidental in that it is coincidental in an audio communication and not a dedicated input for voice training purposes. A device has both audio and text input capabilities so that incidental audio input from audio communications can be received at the same device as the text input. The device may be, for example, an instant messaging client system with both audio and text capabilities, a mobile communication device with both audio and text capabilities, or a server which receives audio and text inputs for processing.

In one embodiment, the audio input of speech has an associated visual input of an image of the input speaker and the method may include generating an image dataset, and wherein synthesizing to synthesized speech may include synthesizing an associated synthesized image, including using the image dataset to personalize the synthesized image to look like the input speaker image. The image of the input speaker may be, for example, a still photographic image, a moving video image, or a computer generated image.

Additionally, the method may include analyzing the text for expression and adding the expression to the synthesized speech. This may include storing paralinguistic expression elements from the audio input of speech and adding the paralinguistic expression elements to the personalized synthesized speech. This may also include storing visual expressions from the visual input and adding the visual expressions to the personalized synthesized image. Analyzing the text may include identifying one or more of the group of: punctuation, letter case, paralinguistic elements, acronyms, emotion icons, and key words. Metadata may be provided in association with text elements to indicate the expression. Alternatively, the text may be annotated to indicate the expression.

An identifier of the source of the audio input may be stored in association with the voice dataset and the voice dataset is used in synthesis of text inputs from the same source.

According to a second aspect of the present invention there is provided a method for text-to-speech synthesis with personalized voice, comprising: receiving an audio input of speech from an input speaker and generating a voice dataset for the input speaker; receiving a text input at a same device as the audio input; analyzing the text for expression; synthesizing the text from the text input to synthesized speech including using the voice dataset to personalize the synthesized speech to sound like the input speaker and adding expression in the personalized synthesized speech.

The audio input of speech may be incidental at a device. However, in this aspect, the audio input may be deliberate for voice training purposes.

According to a third aspect of the present invention there is provided a computer program product stored on a computer readable storage medium for text-to-speech synthesis, comprising computer readable program code means for performing the steps of: receiving an incidental audio input of speech in the form of an audio communication from an input speaker and generating a voice dataset for the input speaker; receiving a text input at a same device as the audio input; synthesizing the text from the text input to synthesized speech including using the voice dataset to personalize the synthesized speech to sound like the input speaker.

According to a fourth aspect of the present invention there is provided a system for text-to-speech synthesis with personalized voice, comprising: audio communication means for input of speech from an input speaker and means for generating a voice dataset for an input speaker; text input means at the same device as the audio input; and a text-to-speech synthesizer for producing synthesized speech including means for converting the synthesized speech to sound like the input speaker.

The system may also include a text expression analyzer and the text-to-speech synthesizer may include means for adding expression to the synthesized speech.

In one embodiment, the system includes a video communication means including the audio communication means with an associated visual communication means for visual input of an image of the input speaker. The system may also include means for generating an image dataset for an input speaker, wherein the synthesizer provides a synthesized image which looks like the input speaker image. The synthesizer may include means for adding expression to the synthesized image.

The system may includes a training module for training a concatenative synthetic voice to sound like the input speaker. The training module may include a voice morphing transformation.

The system may also include means for storing expression elements from the speech input or image input, and the means for adding expression adds the expression elements to the synthesized speech or synthesized image.

The text expression analyzer may provide metadata in association with text elements to indicate the expression. Alternatively, the text expression analyzer may provide text annotation to indicate the expression.

The system may be, for example, an instant messaging system and the audio communication means is an audio chat means, or a mobile communication device, or a broadcasting device, or any other device for receiving text input and also receiving audio input from the same source.

One or more of the text expression analyzer, the text-to-speech synthesizer, and the training module may be provided remotely on a server. A server may also include means for obtaining the audio input from a device for training and text-to-speech synthesis, and output means for sending the output audio from the server to a device.

The system may include means to identify the source of the speech input and means to store the identification in association with the stored voice, wherein the stored voice is used in synthesis of text inputs from the same source.

According to a fifth aspect of the present invention there is provided a method of providing a service to a customer over a network, the service comprising: obtaining a received incidental audio input of speech, in the form of an audio communication, from an input speaker and generating a voice dataset for the input speaker; receiving a text input from a client; synthesizing the text from the text input to synthesized speech including using the voice dataset to personalize the synthesized speech to sound like the input speaker.

BRIEF DESCRIPTION OF THE DRAWINGS

The subject matter regarded as the invention is particularly pointed out and distinctly claimed in the concluding portion of the specification. The invention, both as to organization and method of operation, together with objects, features, and advantages thereof, may best be understood by reference to the following detailed description when read with the accompanying drawings in which:

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numbers may be repeated among the figures to indicate corresponding or analogous features.

DETAILED DESCRIPTION OF THE INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Figure 1:
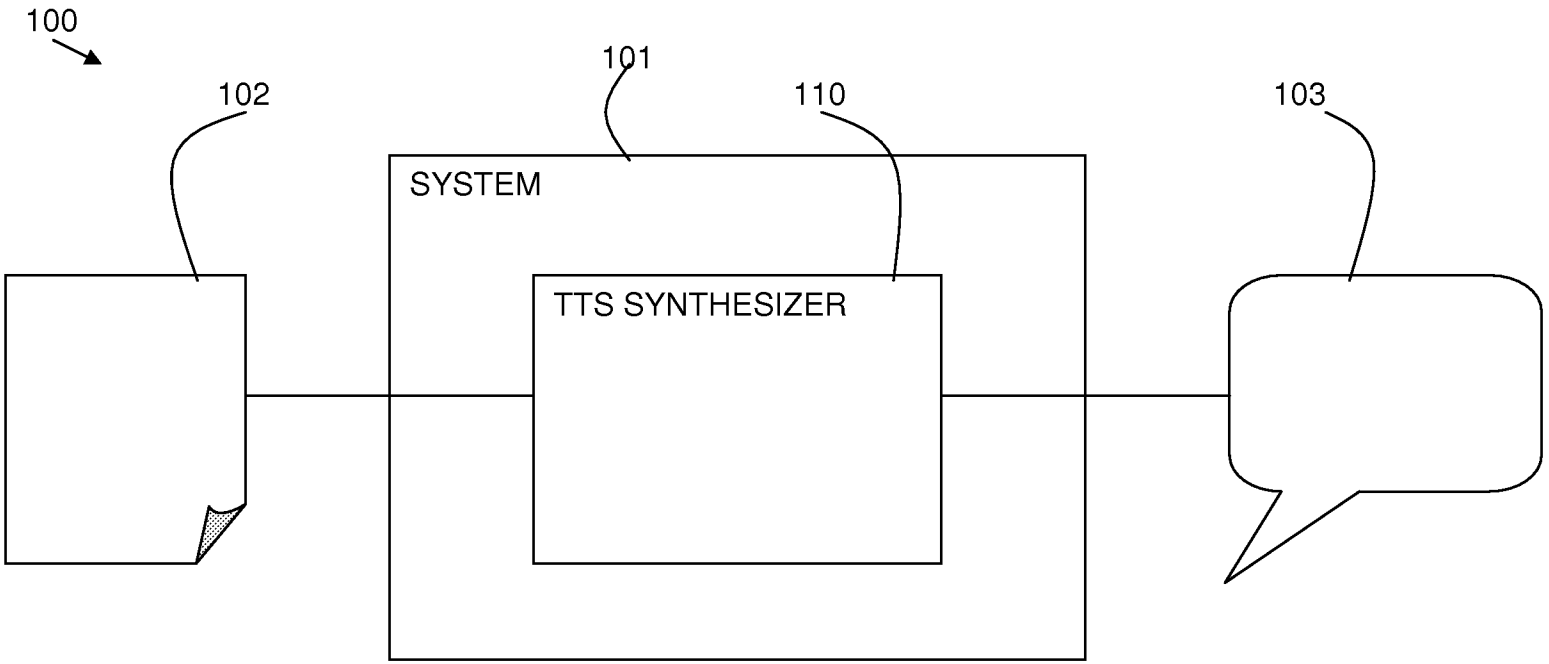
FIG. 1 PRIOR ART
FIG. 1 is a schematic diagram of a text-to-speech synthesis system.

FIG. 1 shows a text-to-speech (TTS) synthesis system 100 as known in the prior art. Text 102 is input into a TTS synthesizer 110 and output as synthesized speech 103. The TTS synthesizer 110 which may be implemented in software or hardware and may reside on a system 101, such as a computer in the form of a server, or client computer, a mobile communication device, a personal digital assistant (PDA), or any other suitable device which can receive text and output speech. The text 102 may be input by being received as a message, for example, an instant message, a SMS message, and email message, etc.

Speech synthesis is the artificial production of human speech. High quality speech can be produced by concatenative synthesis systems, where speech segments are selected from a large speech database. The content of the speech database is a critical factor for synthesis quality. For specific usage domains, the storage of entire words or sentences allows for high-quality output, but limit flexibility. For general purpose text smaller units such as diphones, phones or sub-phonetic units are used for highest flexibility with a somewhat lower quality, depending on the amount of speech recorded in the database. Alternatively, a synthesizer can incorporate a model of the vocal tract and other human voice characteristics to create a completely "synthetic" voice output.

Figure 2:
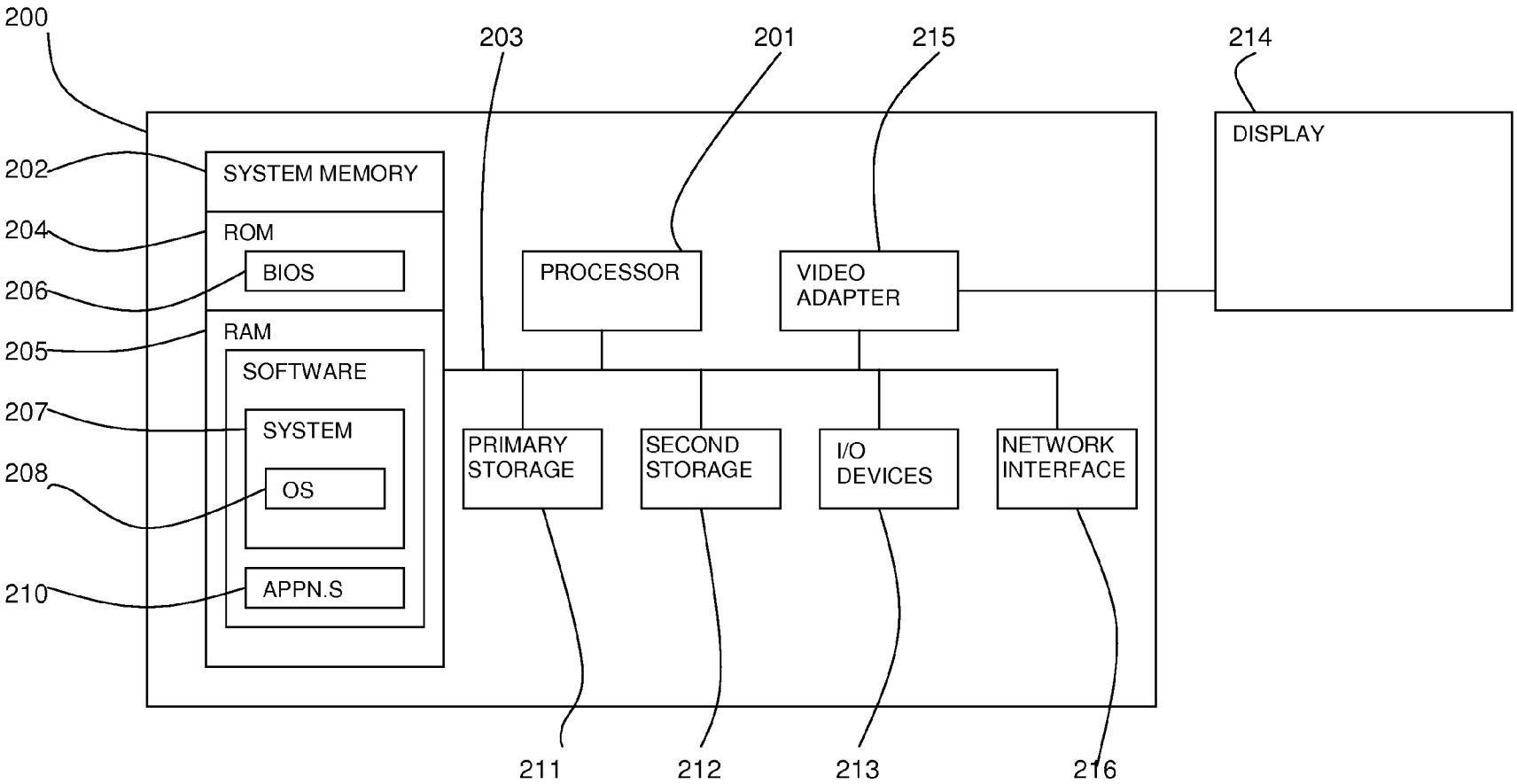
FIG. 2 is a block diagram of a computer system in which the present invention may be implemented.

Referring to FIG. 2, an exemplary system for implementing a TTS system includes a data processing system 200 suitable for storing and/or executing program code including at least one processor 201 coupled directly or indirectly to memory elements through a bus system 203. The memory elements can include local memory employed during actual execution of the program code, bulk storage, and cache memories which provide temporary storage of at least some program code in order to reduce the number of times code must be retrieved from bulk storage during execution.

The memory elements may include system memory 202 in the form of read only memory (ROM) 204 and random access memory (RAM) 205. A basic input/output system (BIOS) 206 may be stored in ROM 204. System software 207 may be stored in RAM 205 including operating system software 208. Software applications 210 may also be stored in RAM 205.

The system 200 may also include a primary storage means 211 such as a magnetic hard disk drive and secondary storage means 212 such as a magnetic disc drive and an optical disc drive. The drives and their associated computer-readable media provide non-volatile storage of computer-executable instructions, data structures, program modules and other data for the system 200. Software applications may be stored on the primary and secondary storage means 211, 212 as well as the system memory 202.

The system 200 may operate in a networked environment using logical connections to one or more remote computers via a network adapter 216. The system 200 also include communication connectivity such as for landline or mobile telephone and SMS communication.

Input/output devices 213 can be coupled to the system either directly or through intervening I/O controllers. A user may enter commands and information into the system 200 through input devices such as a keyboard, pointing device, or other input devices (for example, microphone, joy stick, game pad, satellite dish, scanner, or the like). Output devices may include speakers, printers, etc. A display device 214 is also connected to system bus 203 via an interface, such as video adapter 215.

Figure 3A:
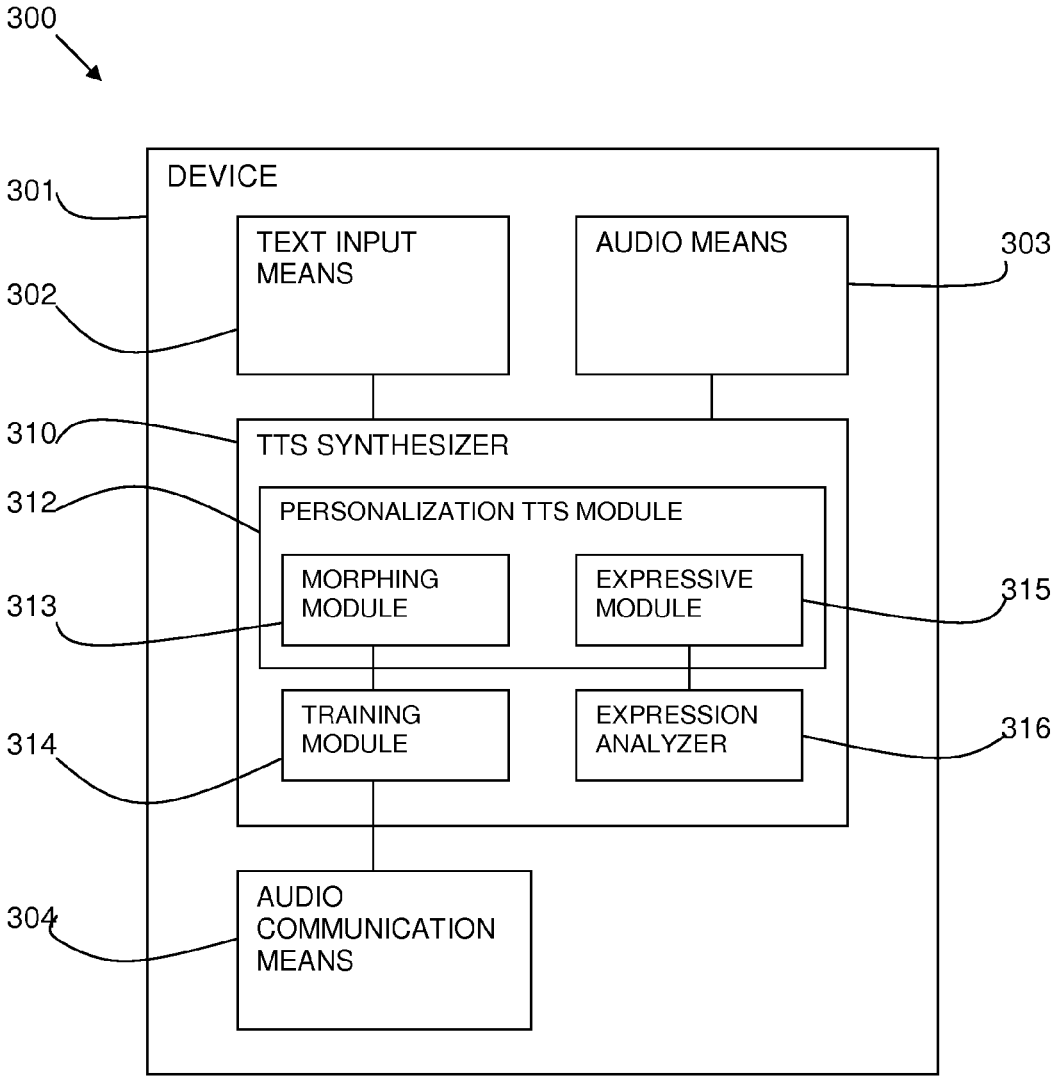
FIG. 3A is a block diagram of an embodiment of a text-to-speech synthesis system in accordance with the present invention.
Figure 3B:
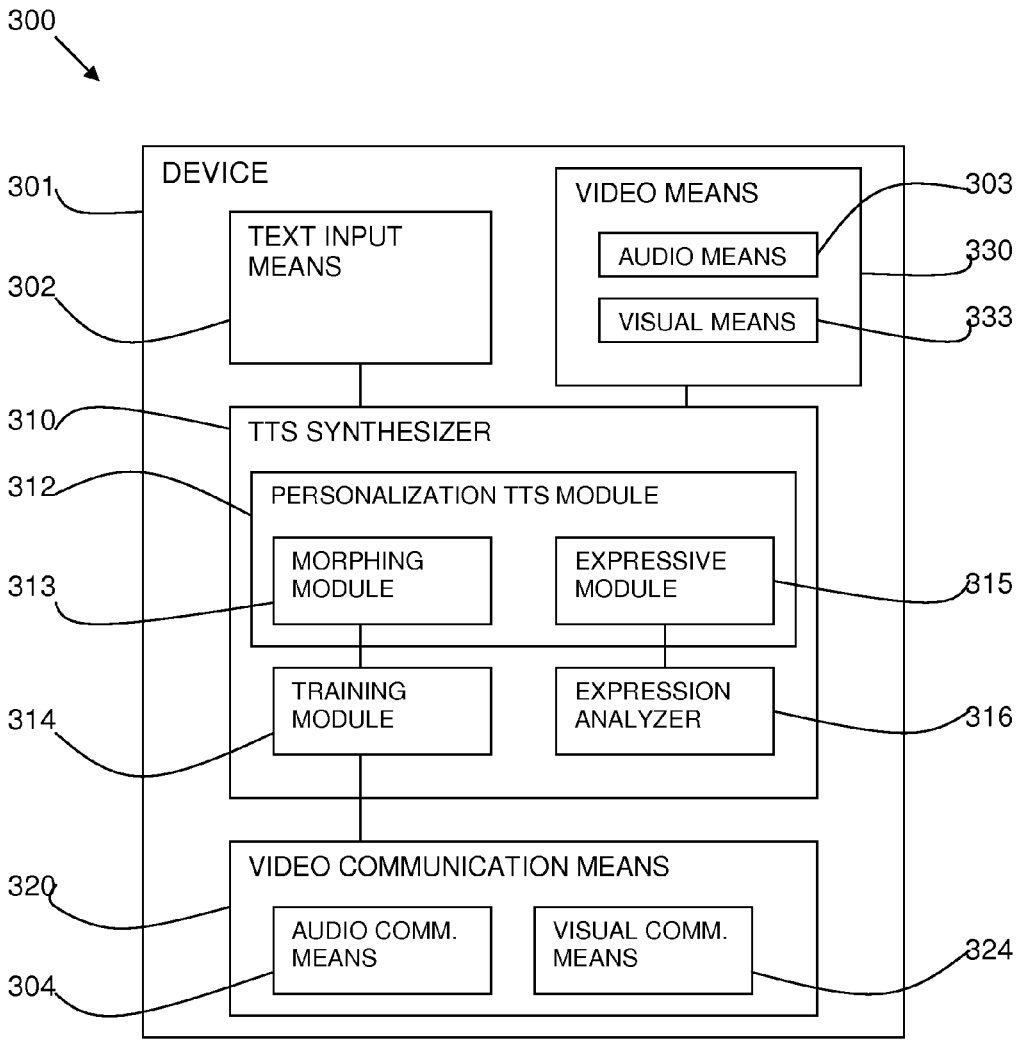
FIG. 3B is a block diagram of another embodiment of a text-to-speech synthesis system in accordance with the present invention.

Referring to FIGS. 3A and 3B a TTS system 300 in accordance with an embodiment of the invention is provided. A device 301 hosts a TTS synthesizer 310 which may be in the form of a TTS synthesis application.

The device 301 includes a text input means 302 for processing by the TTS synthesizer 310. The text input means 302 may include typing or letter input, or means for receiving text from messages such as SMS messages, email messages, IM messages, and any other type of message which includes a text. The device 311 also includes audio means 303 for playing or transmitting audio generated by the TTS synthesizer 310.

The device 301 also includes an audio communication means 304 including means for receiving audio input. For example, the audio communication means 304 may be an audio chat in an IM system, a telephone communication means, a voice message means, or any means of receiving voice signals. The audio communication means 304 is used to record the voice signal which is used in the voice synthesis.

In FIG. 3B, an embodiment is shown in which the audio communication means 304 is part of a video communication means 320 including a visual communication means 324 for providing visual input and output in sync with the audio input and output. For example, the video communication means 320 may be a web cam used in an IM system, or a video conversation capability on a 3G mobile telephone.

In addition in FIG. 3B, the audio means 303 for playing or transmitting audio generated by the TTS synthesizer 310 is part of a video means 330 including a visual means 333. In the embodiment of FIG. 3B, the TTS synthesizer 310 has the capability to also synthesize a visual model in sync with the audio output.

In one aspect of the described method and system of FIGS. 3A and 3B, the audio communication means 304 is used to record voice signals incidentally during normal use of a device. In the case of the embodiment of FIG. 3B, visual signals are also recorded in association with the voice signals during the normal use of the video communication means 320. In the remaining description, references to audio recording include audio recording as part of a video recording. Therefore, dedicated voice recording using repeated words, etc. is not required. A voice signal can be recorded at a user's own device or when received at another user's device.

A TTS synthesizer 310 can be provided at either or both of a sender and a receiver. If it is provided at a sender's device, the sender's voice input can be recorded during any audio session the sender has using the device 301. Text that the sender is sending is then synthesized before it is sent.

If the TTS synthesizer 310 is provided at a receiver's device, the sender's voice input can be captured during an audio communication with the receiver's device 301. Text that the sender sends to the receiver's device is synthesized once it has been received at the receiver's device 301.

In FIG. 3A, the TTS synthesizer 310 includes a personalization TTS module 312 for personalizing the speech output of the TTS synthesizer 310. The personalization TTS module 312 includes an expressive module 315 which adds expression to the synthesis and a morphing module 313 for morphing synthesized speech to a personal voice. A training module 314 is provided for processing voice input from the audio communication means 304 and this is used in the morphing module 313. An emotional text analyzer 316 analyzes text input to interpret emotion and expressions which are then incorporated in the synthesized voice by the expressive module 315.

In the embodiment of FIG. 3B, the TTS synthesizer 310 includes a personalization TTS module 312 for personalizing the speech and visual output of the TTS synthesizer 310. The personalization TTS module 312 includes an expressive module 315, which adds expression to the synthesis in the speech output and in the visual output, and a morphing module 313 for morphing synthesized speech to a personal voice and a visual model to a personalized visual such as a face. A training module 314 is provided for processing voice and visual input from the video communication means 320 and this is used in the morphing module 313. An emotional text analyzer 316 analyzes text input to interpret emotion and expressions which are then incorporated in the synthesized voice and visual by the expressive module 315.

It should be noted that all or some of the above operations that are computationally intensive can be done on a remote server. For example, the whole TTS synthesizer 310 can reside on a remote server. Having the processing done on a server has many advantages including more resources and also access to many voices, and models that have been trained. A TTS synthesizer or personalization training module for a TTS synthesizer may be provided as a service to a customer over a network.

For example, all the audio calls of a certain user are sent to the server and used for training. Then another user can access the library of all trained models on the server, and personalize the TTS with a chosen model of the person he is communicating with.

Figure 4A:
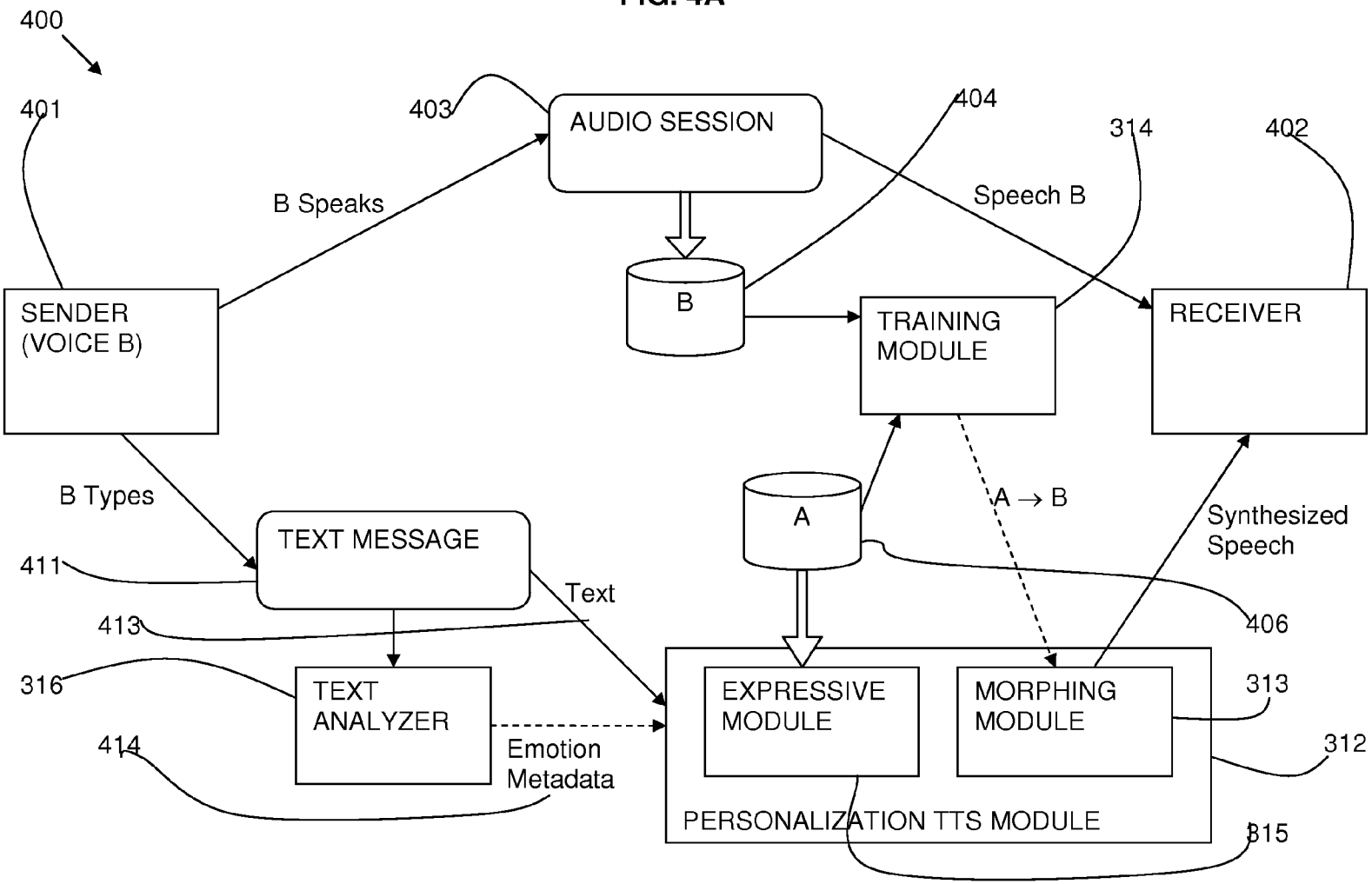
FIG. 4A is a schematic diagram illustrating the operation of the system of FIG. 3A.

Referring to FIG. 4A, a diagram shows the system of FIG. 3A in an operational flow. A sender 401 communicates with a receiver 402. For clarity the diagram describes only one direction of the communication between the sender to the receiver. Naturally, this could be reversed for a two way communication. Also in this example flow, the TTS synthesis is carried out at the receiver end; however, this could be carried out at the sender end.

The sender 401 (voice B) participates in an audio session 403 with the receiver 402. The audio session 403 may be for example, an IM audio chat, a telephone conversation, etc. During an audio session 403, the speech from a sender 401 (voice B) is recorded and stored 404. The recorded speech can be associated with the sender's identification, such as the computer or telephone number from which the audio session is being sent. The recording can continue in a subsequent audio session.

When the total duration of the recording exceeds a predefined threshold, the recording is fed into the offline training module 314. In the preferred embodiment, the training module 314 also receives speech data from a source voice A 406, whose voice is used by a concatenative text-to-speech (CTTS) system. The training module 314 analyses the speech from the two voices and trains a morphing transformation from voice A to voice B. This morphing transformation can be by known methods, such as a linear pitch shift and format shift as described in "Frequency warping based on mapping format parameters", Z. Shuang, et al, in Proc. ICSLP, September 2006, Pittsburgh Pa., USA which is incorporated herein by reference.

In addition, the training module 314 can extract paralinguistic sections from voice B's recording 404 (e.g., laughs, coughs, sighs etc.), and store them for future use.

When a text message 411 is received from the sender 401, the text is first analyzed by a text analyzer 316 for emotional hints, which are classified as expressive text (angry, happy, sad, tired, bored, good news, bad news, etc.). This can be done by detecting various hints in the text message. Those hints can be punctuation marks (???,!!!) case of letters (I'M YELLING), paralinguistic and acronyms (oh, LOL, <sigh>), emoticons like :-) and certain words. Using this information the TTS can use emotional speech or use different paralinguistic audio in order to give better representation of the original text message. The emotion classification is added to the raw text as annotation or metadata, which can be attached to a word, a phrase, a whole sentence.

In a first embodiment, the text 413 and emotion metadata 414 are fed to a personalization TTS module 312. The personalization TTS module 312 includes an expressive module 315, which synthesizes the text to speech using concatenative TTS (CTTS) in a voice A including the given emotion. This can be carried out by known methods of expressive voice synthesis such as "The IBM expressive speech synthesis system", W. Hamza, et al, in Proc. ICSLP, Jeju, South Korea, 2004.

The personalization TTS module 312 also includes a morphing module 313 which morphs the speech to voice B. If there are paralinguistic segments in the speech (e.g. laughter), these are replaced by the respective recorded segments of voice B or alternatively morphed together with the speech.

The output of the personalization TTS module 312 is expressive synthesized speech in a voice similar to that of the sender 401 (voice B).

In an alternative embodiment, the personalization module can be implemented such that the morphing can be done in combination with the synthesis process. This would use intermediate feature data of the synthesis process instead of the speech output. This alternative is applicable for a feature domain concatenative speech synthesis system, for example, the system described in U.S. Pat. No. 7,035,791.

In a further alternative embodiment, the CTTS voice A can be morphed offline to a voice similar to voice B during the offline training stage, and that morphed voice dataset would be used in the TTS process. This offline processing can significantly reduce the amount of computations required during the system's operation, but requires more storage space to be allocated to the morphed voices.

In yet another alternative embodiment, the voice recording from voice B is used directly for generating a CTTS voice dataset. This approach usually requires a much larger amount of speech from the sender, in order to produce high quality synthetic speech.

Figure 4B:
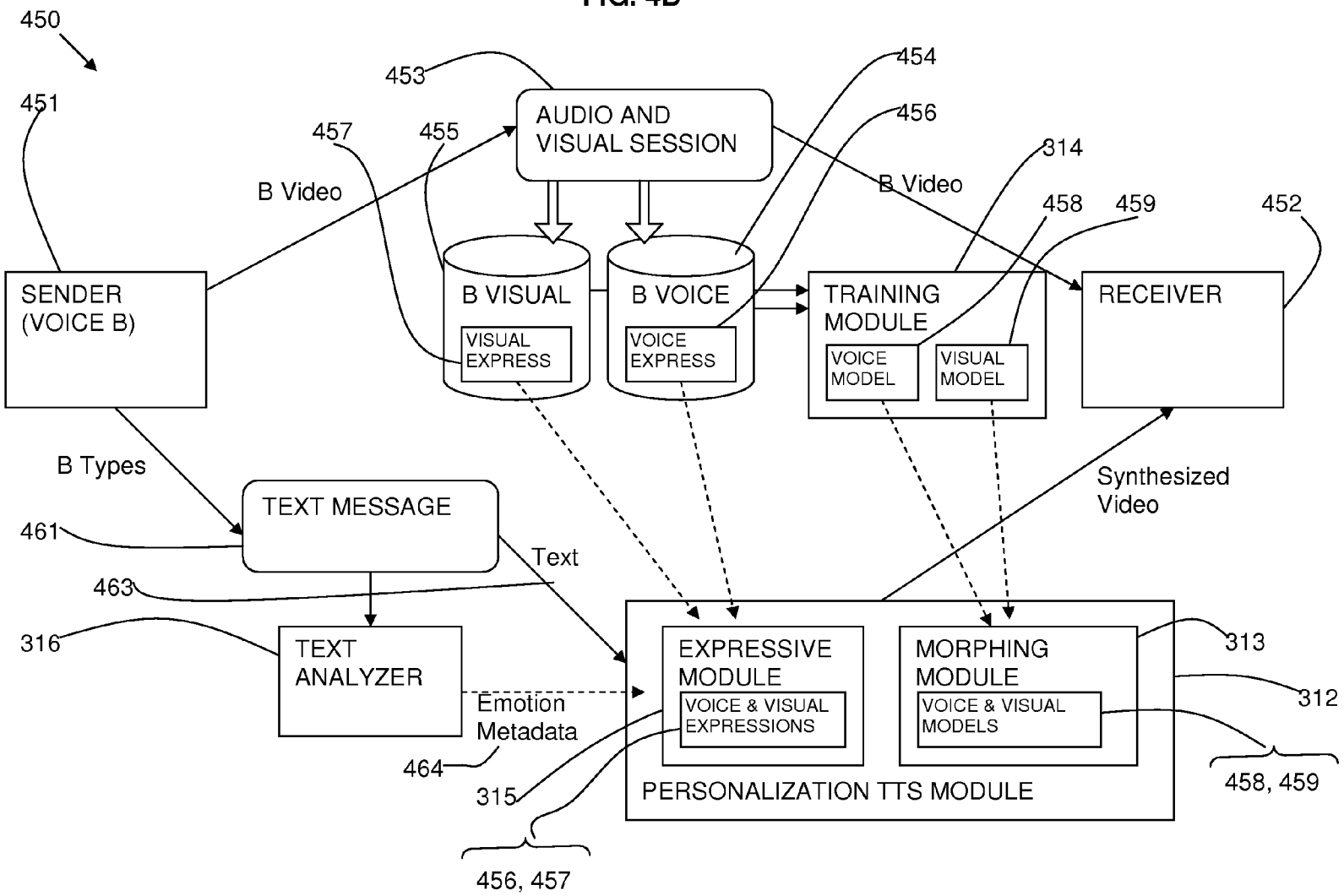
FIG. 4B is a schematic diagram illustrating the operation of the system of FIG. 3B.

Referring to FIG. 4B, a diagram shows the system of the embodiment of FIG. 3B in an operational flow. A sender 451 communicates with a receiver 452. In this embodiment, the sender 451 (video B) participates in a video session 453 with the receiver 452, the video session 453 including audio and visual channels. The video session 453 may be for example, a video conversation on a mobile telephone, or a web cam facility in an IM system, etc. During a video session 453, the audio channel from a sender 451 (voice B) is recorded and stored 454 and the visual channel (visual B) is recorded and stored 455. The recorded audio and visual inputs can be associated with the sender's identification, such as the computer or telephone number from which the video session is being sent. The recording can continue in a subsequent video session.

When the total duration of the recording exceeds a predefined threshold, the recording of both voice and visual is fed into the offline training module 314 which produces a voice model 458 and a visual model 459. In the training module 314, the visual channel is analysed synchronously with the audio channel. A model is trained for the lip movement of a face in conjunction with phonetic context detected from the audio input.

The speech recording 454 includes voice expressions 456 that are captured during the session. For example, laughter, signing, anger, etc. The visual recording 455 includes visual expression 457 that are captured during the session. For example, face expression such as smiling, laughing, frowning, and hand expressions, such as waving, pointing, thumbs up, etc. The expressions are extracted by the training model 314 by analysis of the synchronised audio and visual channels.

The training module 314 receives speech data from a source voice, whose voice is used by a concatenative text-to-speech (CTTS) system. The training module 314 analyses the speech from the two voices and trains a morphing transformation from a source voice to voice B to provide the audio model 458. A facial animation system from text is described in ""May I talk to you?: -)"—Facial Animation from Text" by Albrecht, I. et al the contents of which is incorporated herein by reference.

The training module 314 uses a realistic "talking head" model which is adapted to look like the recorded visual image to provide the visual model 459.

When a text message 461 is received from the sender 451, the text is first analyzed by a text analyzer 316 for emotional hints, which are classified as expressive text. The emotion classification is added to the raw text 463 as annotations or metadata 464, which can be attached to a word, a phrase, a whole sentence.

The text 463 and emotion metadata 464 are fed to a personalization TTS module 312. The personalization TTS module 312 includes an expressive module 315 and a morphing module 313. The morphing module 313 uses the voice and visual models 458, 459 to provide a realistic "talking head" which looks and sounds like the sender 451 with the audio synchronized with the lip movements of the visual.

The output of the personalization TTS module 312 is expressive synthesized speech and visual with a voice similar to that of the sender 451 with a synchronized visual which looks like the sender 451 and includes the sender's gestures and expressions.

Figure 5:
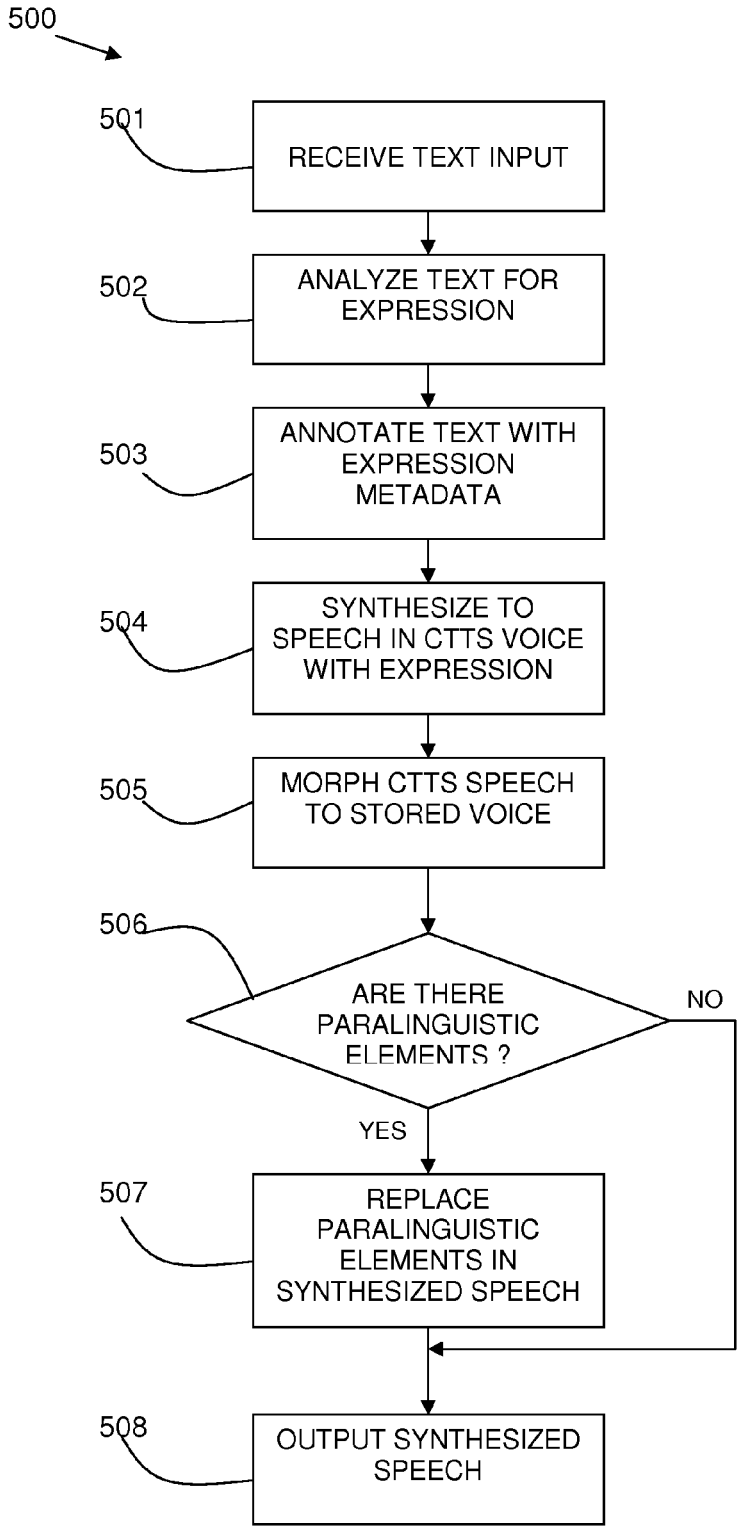
FIG. 5 is a flow diagram in of an example of a method in accordance with the present invention.

FIG. 5 is a flow diagram 500 of an example method of TTS synthesis in accordance with the embodiment of FIG. 3A. A text is received or input 501 at the user device and the text is analyzed 502 to find expressive text. The text is annotated with emotional metadata 503.

The text is then synthesized 504 into speech including the emotions specified by the metadata. The text is first synthesized 504 using a standard CTTS voice (voice A) with the emotion. The synthesized speech is then morphed 505 to sound similar to the sender's voice (voice B) as learnt from previously stored audio inputs from the sender.

It is then determined 506 if there are any paralinguistic elements available in the sender's voice (voice B) that could be substituted into the synthesized speech. For example, if there is a recording of the sender laughing, this could be added where appropriate. If they are available, the synthesized emotion is replace 507, if not it is left unchanged. The synthesized speech is then output 508 to the user.

An example application of the described system is provided in the environment of instant messaging. A component may be provided that performs an extension to any IM system that includes text chat with text-to-speech (TTS) synthesis capability and audio chat. The audio recorded from users in the audio chat sessions can be used to generate personalized speech synthesis in the voices of different users during the text chat sessions.

The recorded audio for a user can be identified with the user's IM identification such that when the user participates in a text chat, the user's IM identification can access the stored audio for speech synthesis.

The system personalizes the voices to sound like the actual participants, based on audio chat's recording of respective users. The recording is used to build a personalized TTS voice, that enables the TTS system to produce speech that resembles the target speaker.

The system also produces emotional or expressive speech based on analysis of the chat's text. This can be done by detecting various hints in the text message. There are features which users may use during a text chat session such as smart icons, emotions icons, and other animated gifs that users can select from a bank of IM features. These features help with giving expression to a text chat and help to put across the right tone to a message. These features can be used to set emotional or expressive metadata for synthesis into speech with emotion or expression. Different rules can be set by the sender or receiver as to how expression should be interpreted. Text analysis algorithms can be applied also on normal text to detect the sentiment in the text.

An IM system which includes video chat using a web cam can include the above features with the addition of a video output including a synthesized audio synchronized to a visual output of a "talking head". The talking head model can be personalized to look like the originator of the text and can include expressions stored from the originator's previously stored visual input.

The TTS system may reside at the receiver side, and the sender can work with a basic IM program with just the basic text and audio chat capabilities. In this case, the receiver has full control of the system.

Alternatively, the system can reside on the sender side, but then the receiver should be able to receive synthesized speech even when a text chat session is open. In the case in which the system operates on the sender's side, any audio chat session will initiate the recording of the sender's speech.

Another alternative, is to connect an additional virtual participant that would listen-in to both sides of a conversation and record what they are saying in audio sessions in a server, where training is performed.

In addition to synthesizing incoming text with personalized and expressive TTS, personal information of the contacts can also be synthesized in their own personalized voice (for example, the contact's name and affiliation, etc.). This can be provided when a user hovers or clicks on the contact or his image. This is useful for blind users to start the chat by searching through the list of names and images and hearing details in the voices of the contacts. It is also possible that each contact will either record a short introduction in his voice, or write it in text that will then be synthesized.

As an additional aspect, the sender or the receiver can override the personalized voice, if desired. For example, in a multi-user chat two personalized voices may sound very similar and the receiver can override the personalized voices to select voices for every participant which vary significantly. In addition, the voice selection can be dynamically modified and can be changed dynamically during use. A user may select a voice from a list of available voices.

A second example application of the described system is provided in the environment of a mobile telephone. An audio message or conversation of a sender to a user's mobile telephone can be recorded and used for voice synthesis for subsequent SMS, email messages, or other forms of messages received from that sender. TTS synthesis for SMS or email messages is useful if the user is unable to look at his device, for example, whilst driving. The sender can be identified by his telephone number from which he is calling and this may be associated with an email address for email messages.

A sender may have the TTS functionality on his device in which case, audio can be recorded from any previous use of the device by the sender and used for training, which would preferably be done on a server. When a sender then sends a message using text, the TTS synthesis is carried out before sending the message as a voice message. This can be useful, if the receiving device does not have the capability to receive the message in text form, but could receive a voice message. Small devices, with low resources can use server based TTS.

In mobile telephones which have 3G capability and include video conversation, a synthesized personalized and expressive video output from text can be provided modeled from video input from a source.

A third example application of the described system is provided on a broadcasting device, such as a television. Audio input can be obtained from an audio communication in the form of a broadcast. Text input in the form of captions can be converted to personalized synthetic speech of the audio broadcaster.

The invention can take the form of an entirely hardware embodiment, an entirely software embodiment or an embodiment containing both hardware and software elements. In a preferred embodiment, the invention is implemented in software, which includes but is not limited to firmware, resident software, microcode, etc.

The invention can take the form of a computer program product accessible from a computer-usable or computer-readable medium providing program code for use by or in connection with a computer or any instruction execution system. For the purposes of this description, a computer usable or computer readable medium can be any apparatus that can contain, store, communicate, propagate, or transport the program for use by or in connection with the instruction execution system, apparatus or device.

The medium can be an electronic, magnetic, optical, electromagnetic, infrared, or semiconductor system (or apparatus or device) or a propagation medium. Examples of a computer-readable medium include a semiconductor or solid state memory, magnetic tape, a removable computer diskette, a random access memory (RAM), a read only memory (ROM), a rigid magnetic disk and an optical disk. Current examples of optical disks include compact disk read only memory (CD-ROM), compact disk read/write (CD-R/W), and DVD.

Improvements and modifications can be made to the foregoing without departing from the scope of the present invention.

We claim:

1. A method for text-to-speech synthesis with personalized voice, comprising:

receiving, at a mobile communications device operated by a user, incidental audio speech data from a sending device operated by a remote input speaker, wherein the speech data of the remote input speaker is received over a first network communication link during a voice communication between the remote input speaker and the user of the mobile communications device;

generating, by the user's mobile communications device, a voice dataset for the remote input speaker based, at least in part, on the incidental audio speech data;

receiving, over a second network communication link, text data at the user's mobile communications device, wherein the text data is sent from the sending device subsequent to the voice communication; and converting, by the user's mobile communications device, the text data to synthesized speech, at least in part, using the voice dataset to personalize the synthesized speech to sound like the remote input speaker.

2. The method as claimed in claim 1, wherein personalizing the synthesized speech includes training a concatenative synthetic voice to sound like the input speaker by using a voice morphing transformation.

3. The method as claimed in claim 1, wherein the audio input of speech data has an associated visual input of an image of the input speaker and the method includes generating an image dataset, and wherein converting to synthesized speech includes synthesizing an associated synthesized image, including using the image dataset to personalize the synthesized image to look like the input speaker image.

4. The method as claimed in claim 3, including:

storing visual expressions from the visual input; and adding the visual expressions to the personalized synthesized image.

5. The method as claimed in claim 1, including:

analyzing the text for expression;

adding the expression to the synthesized speech.

6. The method as claimed in claim 5, including:

storing paralinguistic expression elements from the audio input of speech;

adding the paralinguistic expression elements to the personalized synthesized speech.

7. The method as claimed in claim 5, wherein analyzing the text includes identifying one or more of the group of: punctuation, letter case, paralinguistic elements, acronyms, emotion icons, and key words.

8. The method as claimed in claim 5, wherein metadata is provided in association with text elements to indicate the expression.

9. The method as claimed in claim 5, wherein the text is annotated to indicate the expression.

10. The method as claimed in claim 1, wherein the device is one of the group of: an instant messaging client system, a mobile communication device, a broadcasting device, all with both audio and text capabilities.

11. The method as claimed in claim 1, wherein an identifier of the source of the audio speech data is stored in association with the voice dataset and the voice dataset is used in synthesis of text data from the same source.

12. A computer program product stored on a non-transitory computer readable storage medium for text-to-speech synthesis, comprising computer readable program code means for performing the steps of:

receiving, at a mobile communications device operated by a user, incidental audio speech data from a sending device operated by a remote input speaker, wherein the speech data of the remote input speaker is received over a first network communication link during a voice communication between the remote input speaker and the user of the mobile communications device;

generating, by the user's mobile communications device, a voice dataset for the remote input speaker based, at least in part, on the incidental audio speech data;

receiving, over a second network communication link, text data at the user's mobile communications device, wherein the text data is sent from the sending device subsequent to the voice communication; and converting, by the user's mobile communications device, the text data to synthesized speech, at least in part, using the voice dataset to personalize the synthesized speech to sound like the remote input speaker.

13. A mobile communications device capable of text-to-speech synthesis with personalized voice, comprising:

an audio communication input for receiving over a first network communication link incidental audio speech data from a sending device operated by a remote input speaker during a voice communication between the remote input speaker and a user of the mobile communications device;

a processor configured to generate, at the user's mobile communications device, a voice dataset for the remote input speaker based, at least in part, on the incidental audio speech data;

at least one input for receiving over a second network communication link text data at the user's mobile communication device, wherein the text data is sent from the sending device subsequent to the voice communication; and a text-to-speech synthesizer for producing synthesized speech by converting the text data to synthesized speech to sound like the remote input speaker, at least in part, using the voice dataset.

14. The system as claimed in claim 13, wherein the text-to-speech synthesizer is configured to add expression to the synthesized speech.

15. The system as claimed in claim 13, including a video communication input including the audio communication input with an associated visual communication input for visual data of an image of the remote input speaker, wherein the processor is further configured to generate an image dataset for the remote input speaker, wherein the synthesizer provides a synthesized image which looks like the remote input speaker image.

16. The system as claimed in claim 15, wherein the synthesizer is configured to add expression to the synthesized image.

17. The system as claimed in claim 15, including:

at least one storage medium for storing expression elements from the speech data or visual data, wherein the processor is configured to add the expression elements to the synthesized speech or synthesized image.

18. The system as claimed in claim 13, including a training module for training a concatenative synthetic voice to sound like the input speaker, wherein the training module includes a voice morphing transformation.

19. The system as claimed in claim 13, wherein the text expression analyzer provides metadata in association with text elements to indicate the expression.

20. The system as claimed in claim 13, wherein the text expression analyzer provides text annotation to indicate the expression.

* * * * *